US007077730B2

(12) United States Patent
Kohama et al.

(10) Patent No.: US 7,077,730 B2
(45) Date of Patent: Jul. 18, 2006

(54) METHOD AND APPARATUS FOR POLISHING A WORKPIECE

(75) Inventors: Tatsuya Kohama, Tokyo (JP); Yukiko Nishioka, Tokyo (JP); Yoshikazu Ariga, Fujisawa (JP)

(73) Assignee: Ebara Corporation, Tokyo (JP)

( * ) Notice: Subject to any disclaimer, the term of this patent is extended or adjusted under 35 U.S.C. 154(b) by 44 days.

(21) Appl. No.: 10/883,772

(22) Filed: Jul. 6, 2004

(65) Prior Publication Data

US 2005/0020194 A1 Jan. 27, 2005

(30) Foreign Application Priority Data

Jul. 24, 2003 (JP) ..... 2003-279153

(51) Int. Cl.
*B24B 5/00* (2006.01)
*B24B 29/00* (2006.01)

(52) U.S. Cl. ..... 451/56; 451/57; 451/444

(58) Field of Classification Search ..... 451/41, 451/56, 57, 58, 285, 287, 289, 290, 443, 451/444

See application file for complete search history.

(56) References Cited

U.S. PATENT DOCUMENTS 5,010,692 A * 4/1991 Ishida et al. ..... 451/41
5,651,725 A * 7/1997 Kikuta et al. ..... 451/41
5,857,898 A 1/1999 Hiyama et al.
6,660,124 B1 * 12/2003 Kawasaki et al. ..... 156/345.12

* cited by examiner

*Primary Examiner*—Jacob K. Ackun Jr.
(74) *Attorney, Agent, or Firm*—Wenderoth, Lind & Ponack, L.L.P.

(57) ABSTRACT

A method and apparatus for polishing a workpiece are set forth which can polish the workpiece at a constant rate at a stable condition even when plural workpieces are continually polished. The method comprises dressing a polishing surface of a polishing table while supplying a dressing solution. After the dressing, the dressing solution remaining on the polishing surface is removed by rotating the polishing table at a dewatering rotation speed while stopping the supply of the dressing solution. Then, the workpiece is polished by making the workpiece slidingly contact with the polishing surface while supplying a polishing solution to the polishing surface.

19 Claims, 10 Drawing Sheets

POLISHING CONDITIONS:
Rotation Speed of Polishing Table = 80 rpm
Axial Load = 300hPa
Polishing Time = 60 seconds POLISHING CONDITIONS:
Rotation Speed of Polishing Table = 80 rpm
Axial Load = 300hPa
Polishing Time = 60 seconds DEWATERING CONDITIONS:
Time = 10 seconds
Rotation Speed = 100 rpm

METHOD AND APPARATUS FOR POLISHING A WORKPIECE

BACKGROUND OF THE INVENTION

1. Field of the Invention

The present invention relates to a method and apparatus for polishing a workpiece, and more particularly, to a method and apparatus for polishing a workpiece such as a semiconductor wafer having a thin film formed thereon to a flat and mirror finished surface.

2. Description of the Related Art

As integration of semiconductor devices intensifies, the distance between the interconnects formed in the devices becomes narrower. When forming interconnects of a width not more than 0.5 μm through a photolithography process in particular, the depth of focus becomes shallower and the stepper requires a flatter imaging plane. One prevailing device for flattening or planarizing the surface of the semiconductor wafer is a polishing apparatus for performing chemical mechanical polishing (CMP).

As shown in FIG. 5, such polishing apparatus comprises: a polishing table 302 having a polishing cloth or polishing pad 300 on its upper surface for providing a polishing surface 301; a top ring 304 for holding a workpiece such as a semiconductor wafer W so that the surface to be polished confronts the polishing table 302. The apparatus is operated to polish the semiconductor wafer W by respectively rotating the polishing table 302 and the top ring 304, and by pressing the semiconductor wafer W against the polishing surface 301 by the top ring 304 at a predetermined pressure while supplying a polishing solution from a polishing solution supply nozzle 306 arranged above the polishing table 302 onto the polishing surface 301.

The polishing solution supplied from the polishing solution supply nozzle 306 comprises an alkaline solution containing suspended abrasive grains so that the semiconductor wafer W is flat and mirror polished through a composite process of a chemical polish process by the alkaline solution and a mechanical polish process by the abrasive grains. A fixed abrasive is also used lately, instead of the polishing cloth, in which abrasive grains made of a material such as cerium oxide ($CeO_2$) are fixed by a binder.

As the polishing apparatus continually processes the substrates, polishing performance of the polishing surface 301 of the polishing cloth 300 is deteriorated. Therefore, in order to recover the polishing performance, a dresser 308 having a dressing member 310 at its lower surface is provided for dressing or resetting the polishing cloth 300 during periods such as for exchanging the semiconductor wafer W to be polished. In this dressing process, a dressing solution such as deionized water is supplied to the polishing surface 301 from the water supply nozzle 307, and the dresser 308 and the polishing table 302 are respectively rotated. The dressing member 310 of the dresser 308 is pressed against the polishing surface 301 of the polishing cloth 300 to remove the polishing solution and polishing debris remaining on the polishing surface 301 as well as to flatten and dress the polishing surface 301 for resetting the polishing surface 301. This dressing process is also called a conditioning process.

A process of polishing a semiconductor wafer and dressing the polishing surface using the above described polishing apparatus will be explained with reference to FIGS. 6A~6D and FIG. 7. FIGS. 6A~6D are schematic views showing the conventional polishing process, and FIG. 7 is a graph showing the rotation speeds of the polishing table during these processes. Table 2 also shows conditions of the process mentioned above.

TABLE 2

| | POLISH WITH POLISHING SOLUTION | POLISH WITH DEIONIZED WATER | DRESSING |
|---|---|---|---|
| PROSESS TIME | 60 seconds | 15 seconds | 17 seconds |
| TOP RING POSITION | POLISHING POSITION | POLISHING POSITION | STANDBY POSITION |
| DRESSER POSITION | STANDBY POSITION | STANDBY POSITION | DRESSING POSITION |
| POLISHING SOLUTION | SUPPLY | STOP | STOP |
| DEIONIZED WATER | STOP | SUPPLY | SUPPLY |
| ROTATION SPEED OF POLISHING TABLE | 80 rpm | 80 rpm | 40 rpm |

The semiconductor wafer to be processed (not shown) is placed on a pusher 312 which is arranged adjacent the polishing table 302. As shown in FIG. 6A, during the polishing process using polishing solution, the polishing table 302 and the top ring 304 are rotated independently and the polishing solution is supplied from the polishing solution supply nozzle 306 to the polishing surface 301. At this time, the polishing table 302 is rotated at a speed of 80 rpm, as shown in FIG. 7. The top ring 304 receives semiconductor wafer from the pusher 312 and presses the semiconductor wafer against the polishing surface 301 at a prescribed pressure for 60 seconds to polish the semiconductor wafer.

After finishing polishing using polishing solution, water polishing using deionized water is performed as shown in FIG. 6B. In this process, the polishing table 302 and the top ring 304 are rotated at respective constant speeds and deionized water is supplied from the water supply nozzle 307 to the polishing surface 301. The polishing process using deionized water continues for 15 seconds, as shown in FIG. 7.

After finishing the polishing using deionized water, the polishing cloth 300 is dressed or reset by the dresser 308 for recovering the polishing performance of the polishing surface 301 (see FIG. 5), as shown in FIG. 6C. In the dressing process, the rotation speed of the polishing table 302 is lowered to 40 rpm, and the dressing member 310 of the dresser 308 is forced to slidingly contact with the polishing surface 301 while deionized water is supplied from the water supply nozzle 307 to the polishing surface 301. During this period, the top ring 304 is moved to a position above the pusher 312 and the polished semiconductor wafer is transferred to the pusher 312 from the top ring 304. After finishing the dressing process, deionized water supply is stopped, and the polishing solution is supplied from the polishing solution supply nozzle 306 to the polishing surface 301 to start a next polishing process, as shown in FIG. 6D.

In case of continually polishing the semiconductor wafers, at the time the next polishing process is started, the polishing cloth 300 (see FIG. 5) has just finished the dressing process so that the polishing surface 301 of the polishing cloth 300 is filled with the supplied dressing solution (deionized water). If the polishing solution for the next polishing process is supplied to the polishing surface 301 containing abundant dressing solution, the polishing solution is diluted by the dressing solution having a different composition, as shown in FIG. 6D, so that it is difficult to obtain an expected polishing rate even if the polishing is performed at the same conditions. Also, it is necessary to extend the polishing time to obtain a preferred polishing amount resulting in lowering of the throughput.

The present invention is accomplished to address the above mentioned problems and aimed to present a method and apparatus for polishing a workpiece which can polish the workpiece at a constant rate in a stable condition even when plural workpieces are continually polished.

SUMMARY OF THE INVENTION

According to the present invention, a method for polishing a workpiece comprises: dressing a polishing surface of a polishing table while supplying a dressing solution; after the dressing, removing the dressing solution remaining on the polishing surface by rotating the polishing table at a dewatering rotation speed while stopping the supply of the dressing solution; and after the removing, polishing the workpiece by making the workpiece slidingly contact with the polishing surface while supplying a polishing solution.

According to the invention, when the polishing process is started, the dressing solution remaining on the polishing surface at the end of the dressing process is removed so that dilution of the polishing solution is prevented even when a plurality of semiconductor wafers are continually polished, and a stable polishing process with a constant polishing rate can be achieved.

The removing process removes excessive dressing solution. That is, it is not necessary to remove all the dressing solution remaining on the polishing surface. The dressing solution is removed to an extent to prevent substantial dilution of the polishing solution supplied during the following polishing process so that a constant polishing rate can be obtained.

The dewatering rotation speed may be larger than a rotation speed of the polishing table during the polishing.

A rotation speed of the polishing table during the polishing may be larger than a rotation speed of the polishing table during the dressing process.

The dewatering rotation speed may be between 100~150 rpm.

The removing dressing solution may be performed for 5~15 seconds.

Acceleration at a periphery of the polishing table during the dewatering may be 32.9~73.9 $m/s^2$.

The polishing may comprise a first polishing step using a first polishing solution and a second polishing step using a second polishing solution.

The second polishing solution may be deionized water.

The dewatering rotation speed may be determined according to a driving ability of the polishing table.

According to another aspect of the invention, a method for polishing a workpiece comprises: dressing a polishing surface of a polishing table by making a dresser slidingly contact with the polishing surface while rotating the polishing table at a dressing rotation speed and supplying a dressing solution to the polishing surface; after the dressing, dewatering the polishing surface by rotating the polishing table at a dewatering rotation speed; and after the dewatering, polishing the workpiece by making the workpiece slidingly contact with the polishing surface while rotating the polishing table at a polishing rotation speed and supplying a polishing solution to the polishing surface.

According to another aspect of the invention, an apparatus for polishing a workpiece comprises: a polishing unit having a polishing table having a polishing surface and a workpiece holder for holding the workpiece to press it against the polishing surface; a dressing unit having a dresser for dressing the polishing surface; a solution supplying unit for supplying the polishing surface with a polishing solution or a dressing solution; and a controller for controlling operation of the units, the controller sequentially performs dressing of the polishing surface while supplying a dressing solution, removing the dressing solution remaining on the polishing surface by rotating the polishing table at a dewatering rotation speed while stopping the supply of the dressing solution, and polishing the workpiece by making the workpiece slidingly contact with the polishing surface while supplying a polishing solution.

BRIEF DESCRIPTION OF THE DRAWINGS

FIG. 2A shows a polishing process using a polishing solution, FIG. 2B shows a polishing process using deionized water; FIG. 2C shows a dressing process; FIG. 2D shows a residual deionized water removing process; and FIG. 2E shows a following polishing process;

DETAILED DESCRIPTION OF THE PREFERRED EMBODIMENTS

Figure 1A:
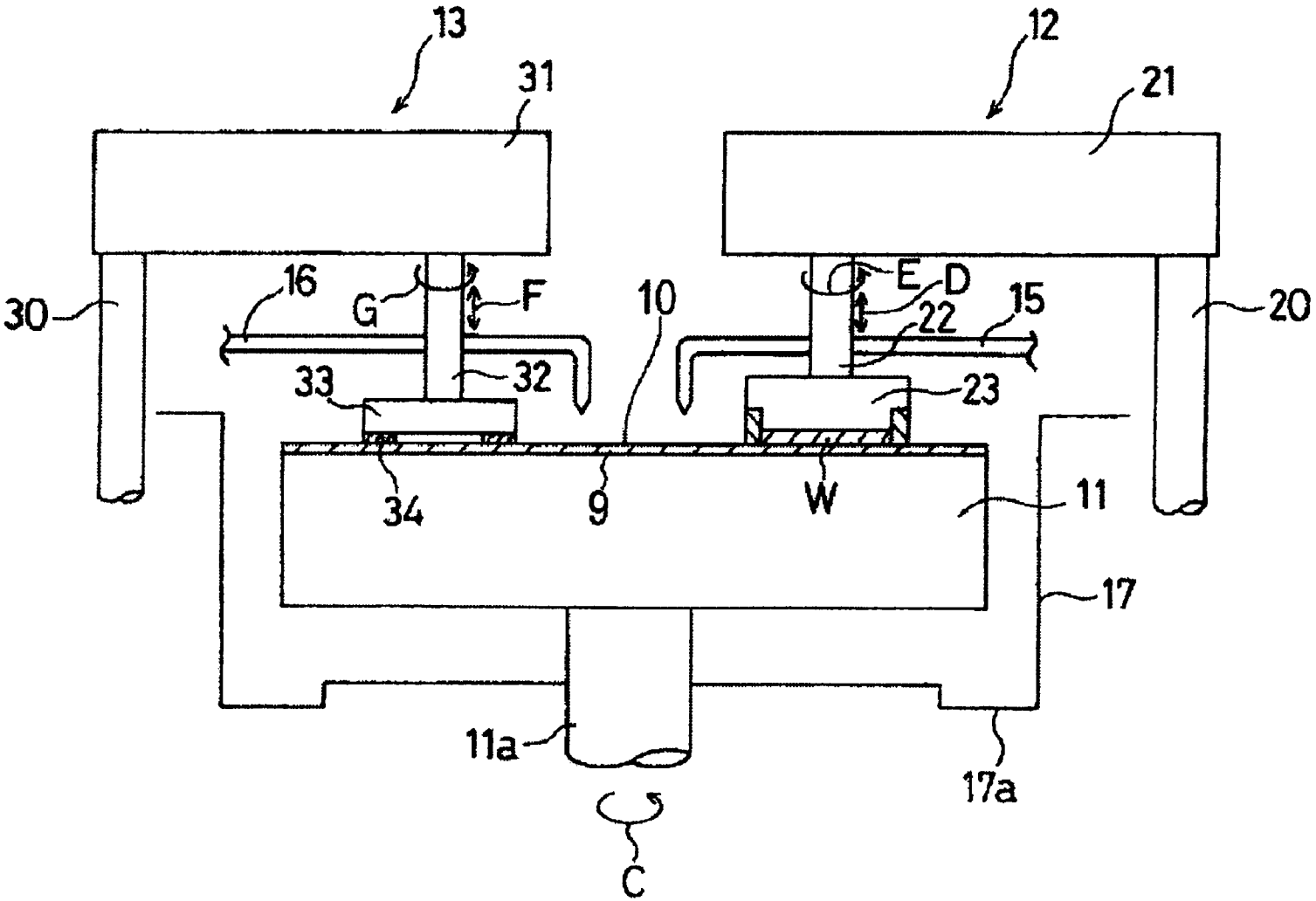
FIG. 1A is a cross-sectional schematic view of a polishing apparatus according to an embodiment of the present invention.
Figure 1B:
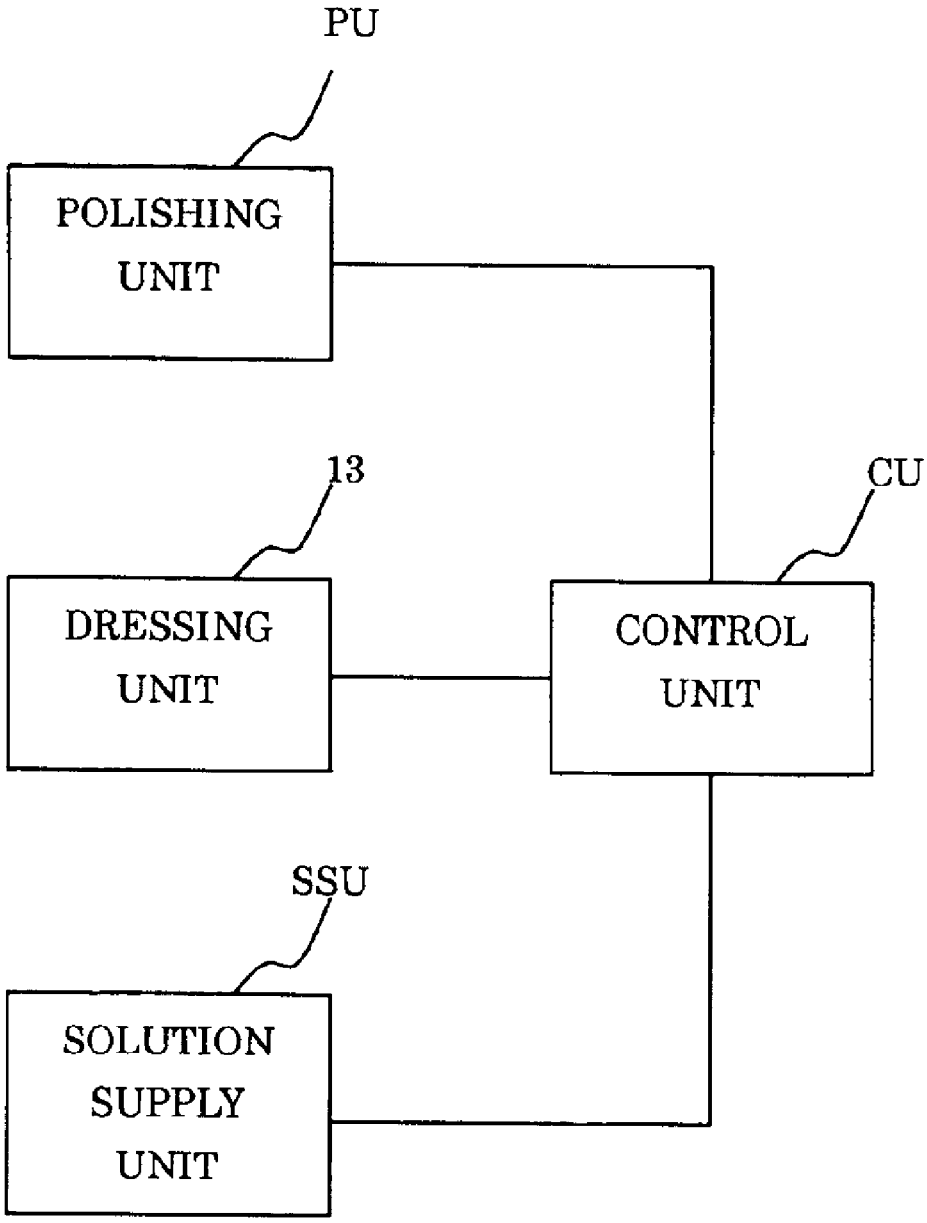
FIG. 1B is a block diagram of the polishing apparatus shown in FIG. 1A.

An embodiment of the polishing apparatus and process according to the present invention will be described with reference to the attached drawings. FIG. 1A is a schematic view showing an apparatus for performing a polishing process of the present invention, and FIG. 1B is a block diagram of the polishing apparatus shown in FIG. 1A. The polishing apparatus comprises: a polishing table 11 having a polishing surface 10 on the upper surface; a top ring unit 12 for holding a semiconductor wafer W, a workpiece to be polished, and pressing it against the polishing table 11 to polish the same; and a dressing unit 13 for dressing or resetting the polishing surface 10 of the polishing table 11. The polishing table 11 is connected to a motor, not shown and arranged below the table, via a table shaft 11*a* so that the polishing table 11 is rotatable about the table shaft 11*a* as indicated by an arrow C in FIG. 1A.

In the embodiment, the polishing surface 10 for polishing the semiconductor wafer W is comprised of a polishing cloth 9 or polishing pad. Here, the term "polishing cloth" is used for a cloth such as a foamed polyurethane or nonwoven fabric cloth which does not include abrasive grains.

A polishing solution supply nozzle 15 and a water supply nozzle 16 are arranged above the polishing table 11, thus the polishing solution supply nozzle 15 supplies a polishing solution or slurry and the water supply nozzle 16 supplies deionized water respectively onto the polishing surface 10 of the polishing table 11. A cup-like frame member 17 is provided around the polishing table 11 for recovering the polishing solution and deionized water, and a ditch 17*a* is provided at a lower portion of the frame member 17.

The top ring unit 12 comprises: a rotatable support shaft 20; a swing arm 21 connected to the upper end of the support shaft 20; a top ring shaft 22 suspended from a free end of the swing arm 21; and a disc-like top ring 23 connected to the lower end of the top ring shaft 22. The top ring 23 is horizontally movable by the swinging movement of the swing arm 21 rotated by the support shaft 20, thus the top ring 23 is reciprocatingly movable between a delivery position above the pusher (wafer delivery unit, not shown) adjacent the polishing table 11 and a polishing position above the polishing surface 10. The top ring 23 is connected to a motor (a rotation drive assembly) and an elevation cylinder, both not shown and provided inside the swing arm 21, via the top ring shaft 22 so that the top ring 23 is elevatable as well as rotatable about the top ring shaft 22 as shown by the arrows D and E in FIG. 1A. The semiconductor wafer W, a workpiece to be polished, is supported at the lower surface of the top ring 23 by a vacuum suction force or the like. By these configurations, the top ring 23 can rotatingly support the semiconductor wafer W at the lower surface and press it against the polishing surface 10 at a desirable pressure.

The dressing unit 13 is for reactivating the polishing surface 10 which is deteriorated through polishing, and is arranged at an opposite side of the center of the polishing table 11 to the top ring unit 12. The dressing unit 13 comprises, similarly to the top ring unit 12: a rotatable support shaft 30; a swing arm 31 connected to the upper end of the support shaft 30; a dresser shaft 32 suspended from a free end of the swing arm 31; and a dresser 33 connected to the lower end of the dresser shaft 32. Thus the dresser 33 is horizontally movable according to the swing movement of the swing arm 31 caused by rotation of the support shaft 30 so that the dresser 33 can move reciprocatingly between a dressing position above the polishing surface 10 and a standby position outside the polishing table 11. The dresser 33 is connected to a motor (a rotation drive assembly) and an elevation cylinder, both not shown and provided inside the swing arm 31, via the dresser shaft 32 so that the dresser 33 is elevatable as well as rotatable about the dresser shaft 32 as shown by the arrows F and G in FIG. 1A.

The dresser 33 comprises at its lower surface a dressing member 34 which slidingly contacts with the polishing surface 10 to dress the same. The dresser 33 presses the dressing member 34 against the polishing surface 10 at a desired pressure while rotating to dress the polishing surface 10. The dressing member 34 comprises diamond grains deposited on its lower surface through electrodeposition or welding.

The polishing table 11, the top ring unit 12, and their auxiliary devices construct a polishing unit PU. The polishing solution supply nozzle 15, the water supply nozzle 16, and their auxiliary devices such as solution tanks, conduits, pumps or valves construct a solution supply unit SSU. The polishing unit PU, the dressing unit 13 and the solution supply unit SSU are connected to and controlled by a controller unit CU, as shown in FIG. 1B. The controller unit CU comprises a CPU, for example, installed with a program to control the polishing apparatus in a manner as follows.

Figure 2A:
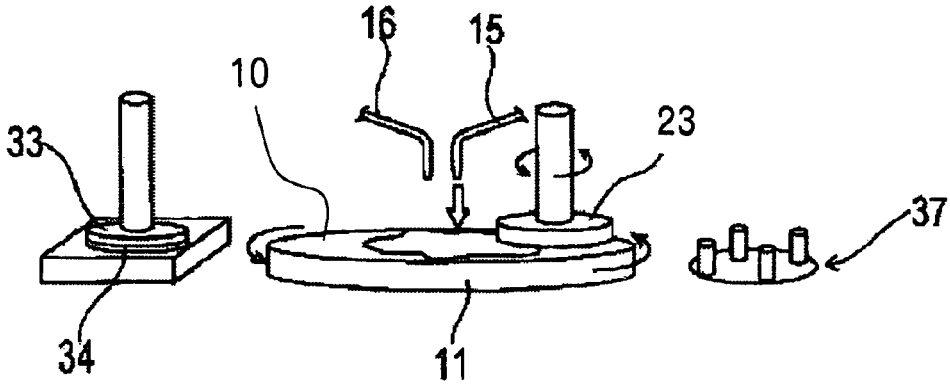
FIGS. 2A~2E show views illustrative of a polishing process carried out by the polishing apparatus shown in FIG. 1A.
Figure 2B:
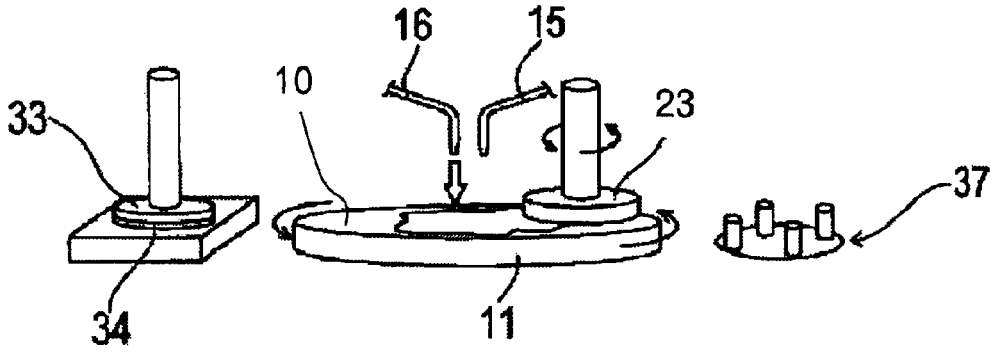
Figure 2C:
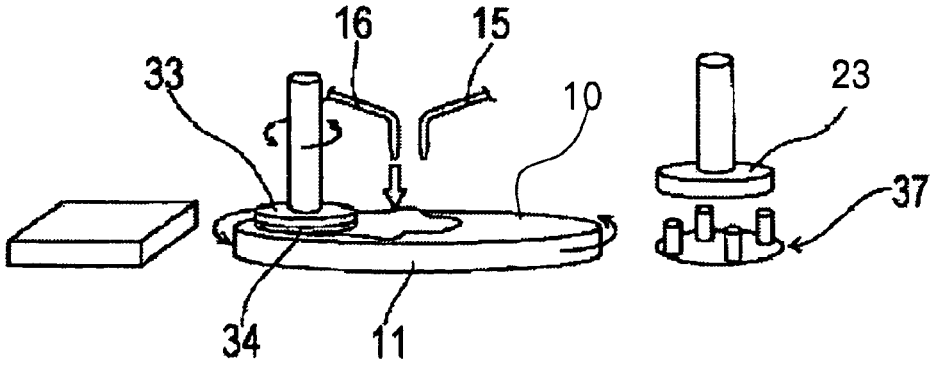
Figure 2D:
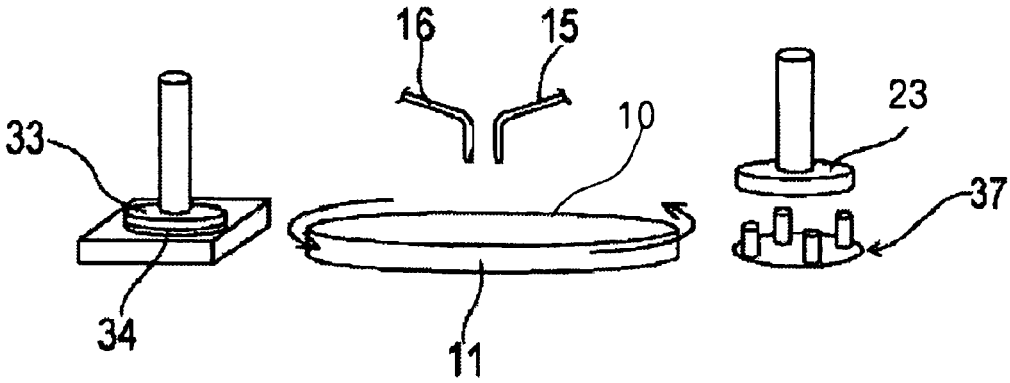
Figure 2E:
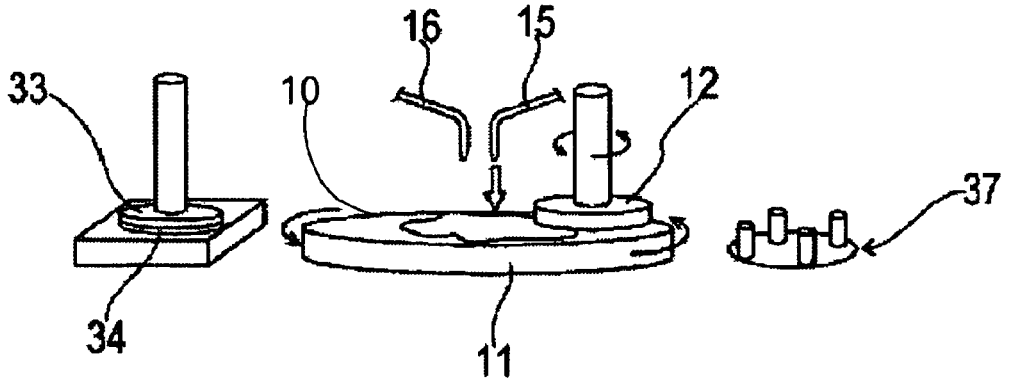
Figure 3:
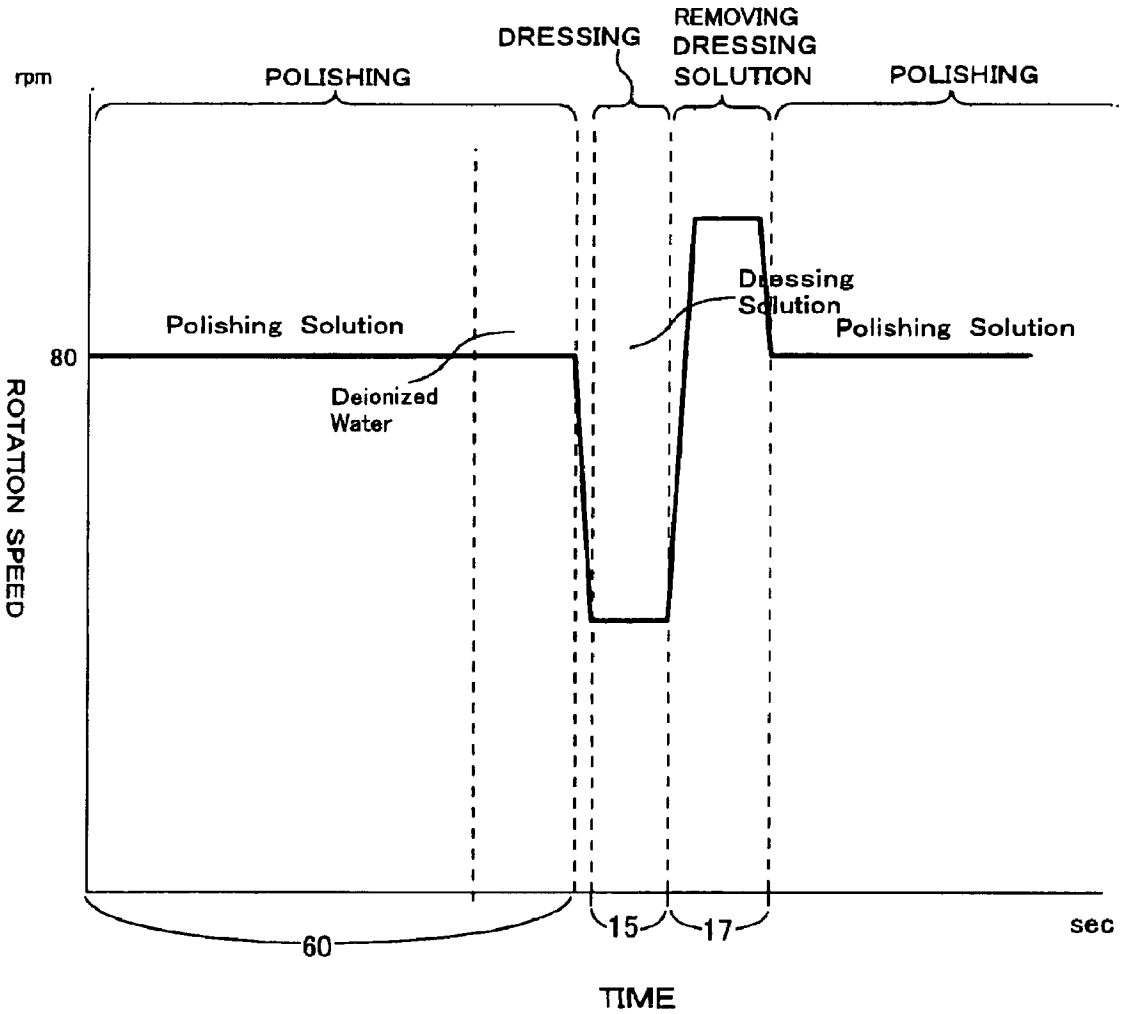
FIG. 3 is a graph showing rotational speeds of the polishing table in respective processes shown in FIG. 2.

Processes for polishing a semiconductor wafer W and dressing the polishing surface 10 by using the above described polishing apparatus will be described by referring to FIGS. 2A~2E, FIG. 3, and Table 1. FIG. 2A is a schematic view of a polishing process using a polishing solution, FIG. 2B is a schematic view showing a polishing process using deionized water. FIG. 2C is a schematic view showing a dressing process, FIG. 2D is a schematic view showing a process for removing deionized water remaining on the polishing surface 10, and FIG. 2E is a schematic view showing a next polishing process using polishing solution. Table 1 shows respective processing conditions of the steps shown in FIGS. 2A~2E. FIG. 3 is a graph showing rotation speeds of the polishing table 11 in the respective steps of FIGS. 2A~2E.

TABLE 1

| | POLISH WITH POLISHING SOLUTION | POLISH WITH DEIONIZED WATER | DRESSING | DEWATERING |
|---|---|---|---|---|
| PROCESS TIME | 60 seconds | 15 seconds | 17 seconds | 10 seconds |
| TOP RING POSITION | POLISHING POSITION | POLISHING POSITION | PUSHER | PUSHER |
| DRESSER POSITION | STANDBY POSITION | STANDBY POSITION | DRESSING POSITION | STANDBY POSITION |
| POLISHING SOLUTION | SUPPLY | STOP | STOP | STOP |
| DEIONIZED WATER | STOP | SUPPLY | SUPPLY | STOP |
| ROTATION SPEED OF POLISHING TABLE | 80 rpm | 80 rpm | 40 rpm | 100 rpm |

As shown in FIG. 2A, a pusher 37 is arranged adjacent the polishing apparatus for delivery of the semiconductor wafer W between the top ring 23. The semiconductor wafer W (not shown) placed on the pusher 37 is held at the lower surface of the top ring 23 by vacuum suction force or the like and is transferred to the position above the polishing surface 10 of the polishing table 11 by the top ring 23. The top ring 23 and the polishing table 11 are readily rotated respectively and the polishing solution is supplied onto the polishing surface 10 from the polishing solution supply nozzle 15. At this time, the rotation speed of the polishing table 11 is controlled at 80 rpm as shown in table 1 and FIG. 3. The top ring 23 presses the semiconductor wafer W held at the lower surface thereof against the polishing surface 10 of the polishing table 11 at a prescribed pressure for 60 seconds. Thus the semiconductor wafer W held by the top ring 23 is in a sliding contact with the polishing surface 10 so that polishing is performed using the polishing solution.

After finishing the polishing process using the polishing solution, the supply of the polishing solution is stopped and deionized water is supplied from the water supply nozzle 16 to the polishing surface 10 to perform a water polishing using deionized water, as shown in FIG. 2B. In this process, the polishing table 11 and the top ring 23 are rotated at respective constant speeds, and the top ring 23 presses semiconductor wafer W against the polishing surface 10 for 15 seconds. By this water polishing using deionized water, the abrasive grains adhering to the surface of the semiconductor wafer W is cleaned and removed. The rotation speeds of the polishing table 11 and the top ring 23 can be changed from those during polishing using the polishing solution. In this case, the rotation speed of the polishing table 11 can be set within a range slower than that during polishing using the polishing solution, faster than that during polishing using deionized water, and also slower than that during dressing the polishing table 11, such as 50 rpm, for example.

Then the polishing surface 10 is subjected to a dressing process using the dressing unit 13 (see FIG. 1A) for recovering the polishing performance. As shown in FIG. 2C, when dressing the polishing surface 10, the top ring 23 is moved to the position above the pusher 37 and the polished semiconductor wafer W is delivered to the pusher 37. At the same time, the dresser 33 of the dressing unit 13 is moved to the position above the polishing surface 10. Then the dressing member 34 is forced to slidingly contact with the polishing surface 10 at a predetermined pressure, while the dresser 33 and a polishing table 11 are independently rotated. When or before the dressing member 34 contacts the polishing surface 10, deionized water as a dressing solution is supplied to the polishing surface 10 from the water supply nozzle 16. As to the dressing solution, a solution having a different composition from the polishing solution is normally used. The dressing process continues for 17 seconds in which the rotation speed of the polishing table 11 is lowered to 40 rpm, as shown in FIG. 3. After the dressing process, the dresser 33 is returned to the standby position by being driven by the swing arm 31 and, at the same time, deionized water supply from the water supply nozzle 16 is stopped.

After finishing the dressing process, residual deionized water on the polishing surface 10 of the polishing table 11 will be removed, that is, the polishing table 11 is dewatered. In this process, the rotation speed of the polishing table 11 is raised to 100 rpm. Deionized water remaining on the polishing surface 10 is outwardly scattered from the polishing table 11 due to the centrifugal force caused by the rotation of the polishing table 11 so that the deionized water remaining on the polishing surface 10 is removed. This water removing process continues for 10 seconds as shown in FIG. 3. The scattered deionized water from the polishing surface 10 is recovered by the ditch 17*a* provided at the lower portion of the frame member 17 shown in FIG. 1A. In the present embodiment, it is preferable to perform the removing process for 5~15 seconds. It is also preferable to set the rotational speed at 100~150 rpm. In case where the diameter of the polishing table 11 is 600 millimeter, the acceleration at the periphery of the polishing table 11 is preferably in the range of 32.9~73.9 $m/s^2$.

After removing deionized water, the rotation speed of the polishing table 11 is lowered to a usual polishing speed such as 80 rpm, and the polishing surface 10 of the polishing table 11 is supplied with the polishing solution from polishing solution supply nozzle 15 to start the next polishing process as shown in FIG. 2E. When the next polishing process is started, deionized water does not remain substantially on the polishing surface so that dilution of the polishing solution, which is supplied to the polishing surface 10, by the deionized water is prevented so that, even when a plurality of semiconductor wafers are continually polished, a stable polishing process with a desired polishing rate can be achieved. Also, a necessary time for removing the deionized water from the polishing surface is as short as 5~15 seconds, this dressing solution removing process does not affect substantially the whole processing time. Therefore, the polishing process can be stably achieved without decreasing the throughput.

In the embodiment, the above described processes are controlled by the controller unit CU, but it is also possible to manually control to perform the same process.

Figure 4:
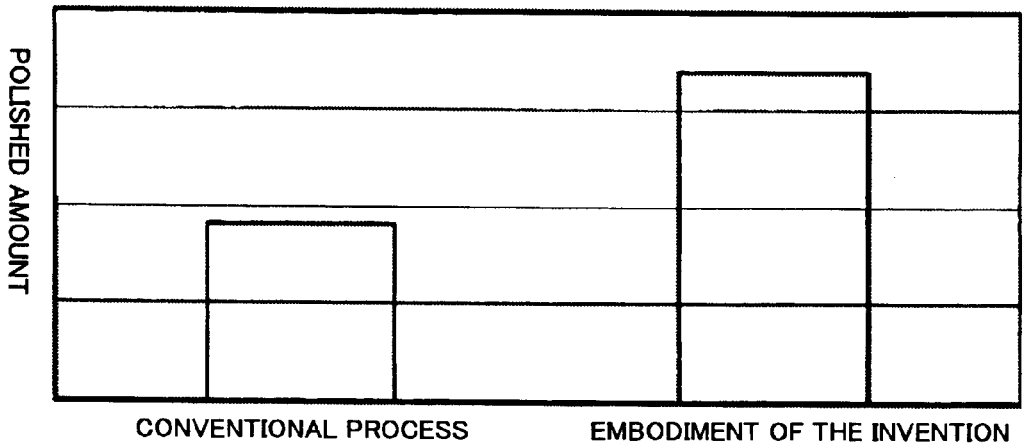
FIG. 4 is a graph showing rotational speeds of the polishing table in respective processes shown in FIG. 2.
Figure 5:
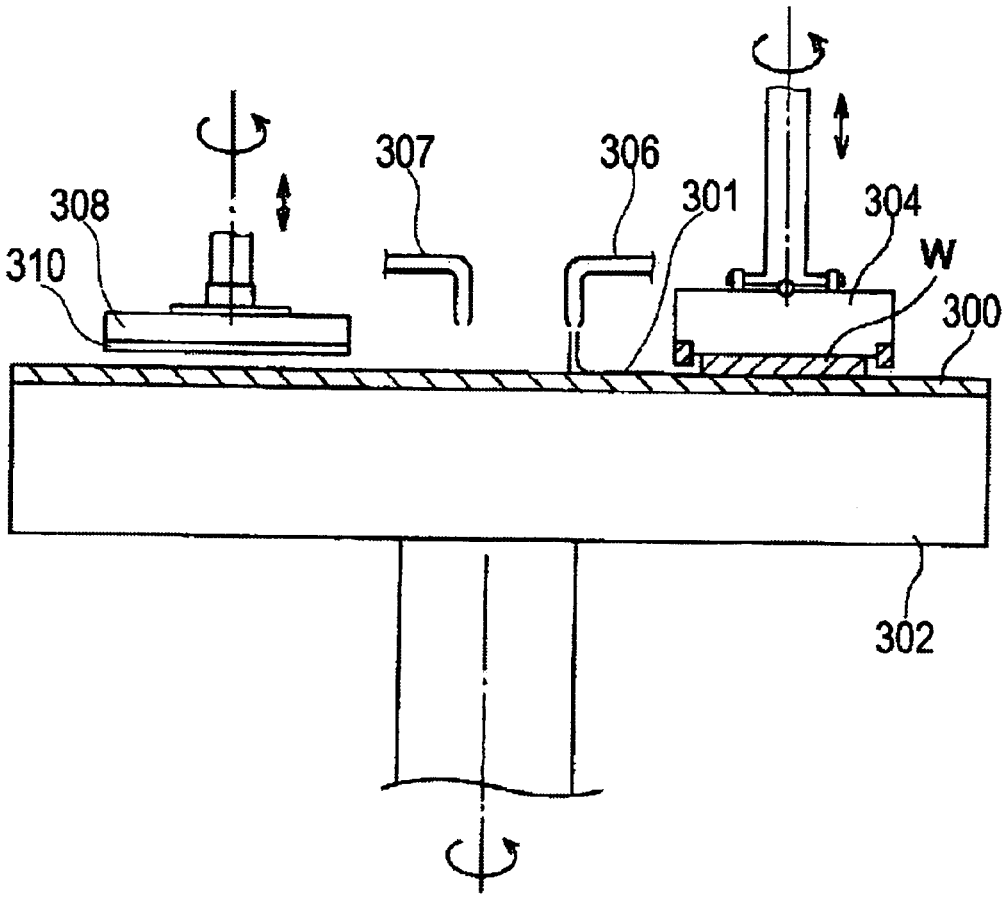
FIG. 5 is a cross-sectional schematic view of a conventional polishing apparatus.
Figure 6A:
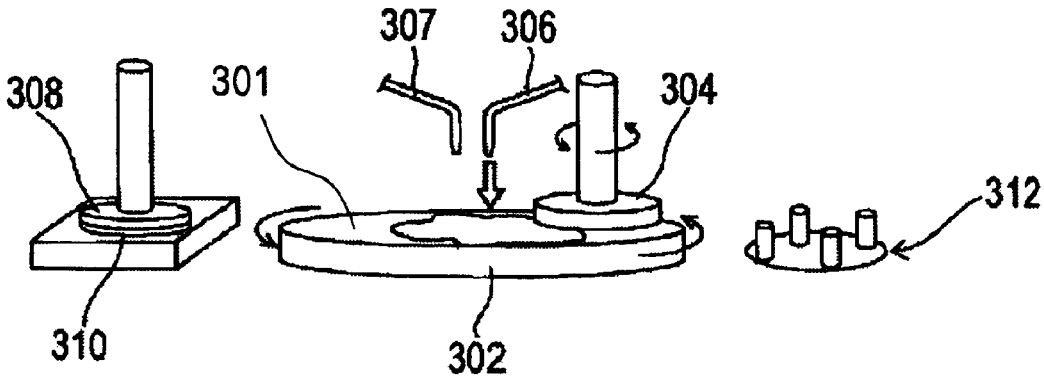
FIGS. 6A~6D show views illustrative of a polishing process carried out by the conventional polishing apparatus.
Figure 6B:
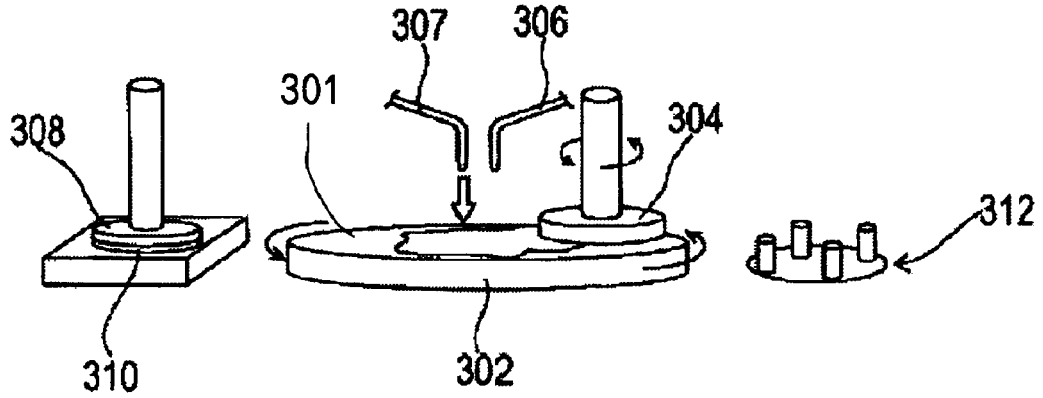
Figure 6C:
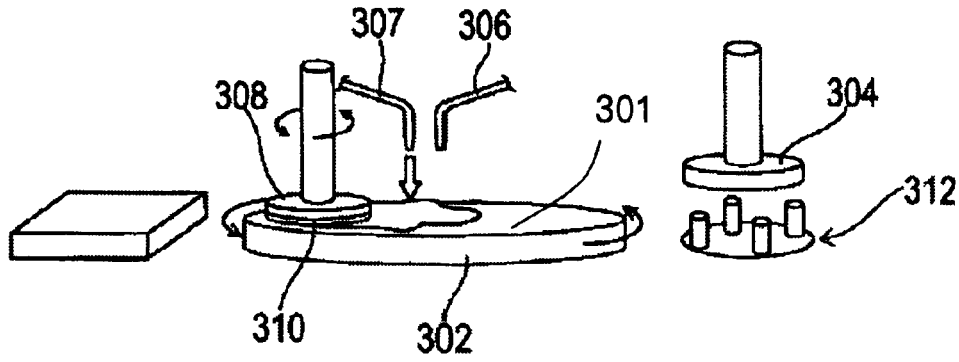
Figure 6D:
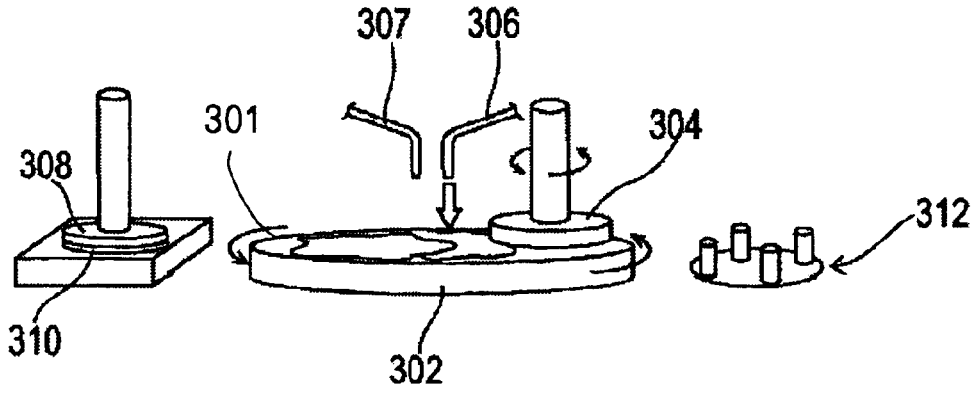
Figure 7:
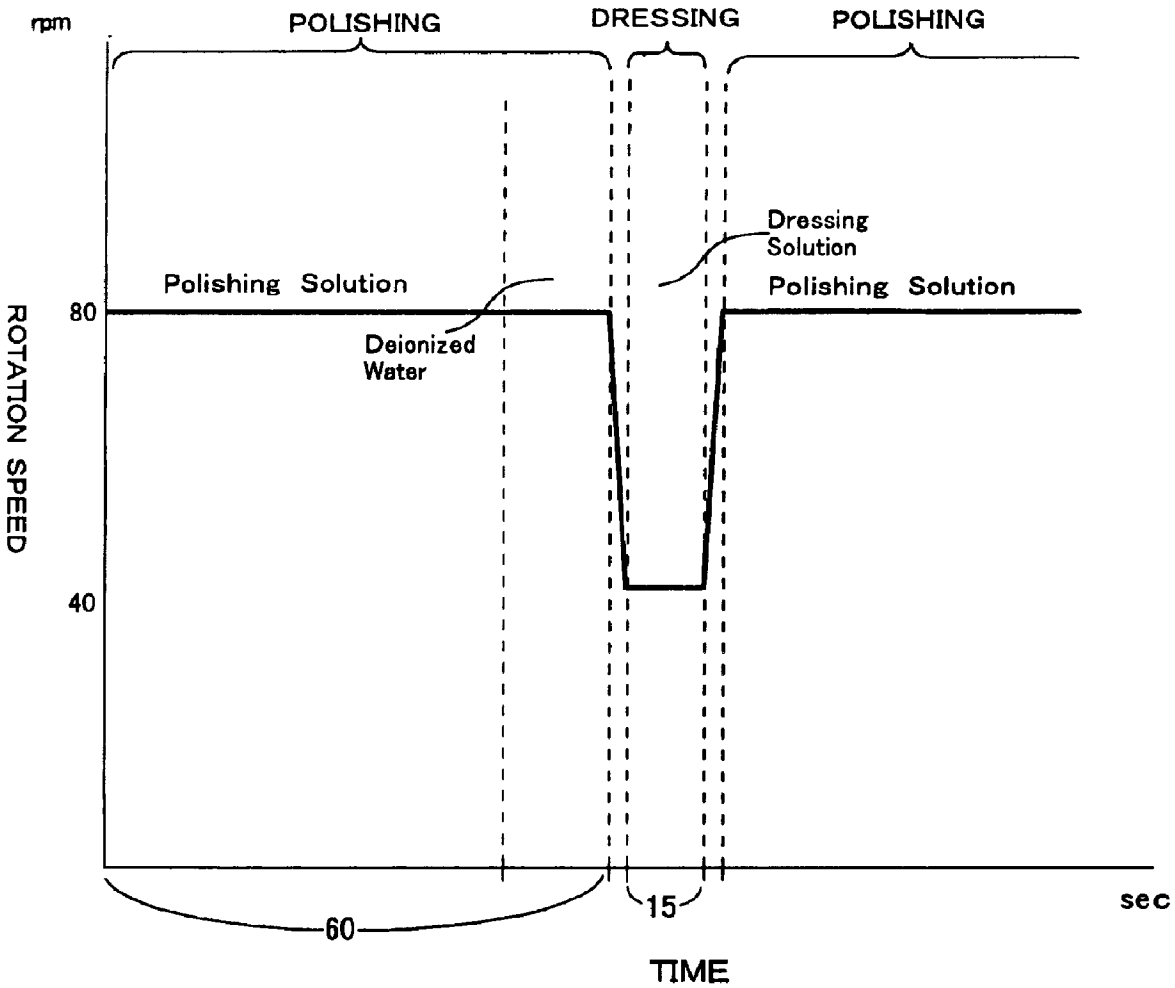
FIG. 7 is a graph showing rotational speeds of the polishing table in respective processes shown in FIGS. 6A~6D.

FIG. 4 is a graph showing the results of the polishing amount in the embodiment of the present invention compared to that in a conventional process. Both polishing processes are performed in the following polishing conditions: the rotational speed of the polishing table is 80 rpm, the axial load is 300 hPa, and the polishing time is 60 seconds. Here, the axial load is the load working on the top ring shaft in an axial direction.

In the conventional polishing process, the rotation speed of the polishing table is not raised after the dressing process, while, in the polishing process of the present invention, the rotation speed of the polishing table is raised to 100 rpm for 10 seconds after the dressing process. Accordingly, as shown in FIG. 4, the polishing rate of the polishing process according to the present invention is twice as much as the conventional polishing process. It is permissible to raise the rotational speed up to 150 rpm after the dressing process, if the polishing apparatus facility allows.

What is claimed is:

1. A method for polishing a workpiece comprising:

dressing a polishing surface of a polishing table while supplying a dressing solution;

after said dressing, removing said dressing solution remaining on said polishing surface by rotating said polishing table at a dewatering rotation speed while stopping said supply of said dressing solution; and after said removing, polishing said workpiece by making said workpiece slidingly contact with said polishing surface while supplying a polishing solution to said polishing surface.

2. The method of claim 1, wherein said dewatering rotation speed is larger than a rotation speed of said polishing table during said polishing.

3. The method of claim 1, wherein a rotation speed of said polishing table during said polishing is larger than a rotation speed of said polishing table during said dressing process.

4. The method of claim 1, wherein said dewatering rotation speed is between 100~150 rpm.

5. The method of claim 1, wherein said removing dressing solution is performed for 5~15 seconds.

6. The method of claim 1, wherein acceleration at a periphery of said polishing table during said dewatering is 32.9~73.9 $m/s^2$.

7. The method of claim 1, wherein said polishing comprises a first polishing step using a first polishing solution and a second polishing step using a second polishing solution.

8. The method of claim 7, wherein said second polishing solution is deionized water.

9. The method of claim 1, wherein said dewatering rotation speed is determined according to a driving ability of said polishing table.

10. A method for polishing a workpiece comprising:

dressing a polishing surface of a polishing table by making a dresser slidingly contact with said polishing surface while rotating said polishing table at a dressing rotation speed and supplying a dressing solution to said polishing surface;

after said dressing, dewatering said polishing surface by rotating said polishing table at a dewatering rotation speed while stopping said supply of said dressing solution; and after said dewatering, polishing said workpiece by making said workpiece slidingly contact with said polishing surface while rotating said polishing table at a polishing rotation speed and supplying a polishing solution to said polishing surface.

11. An apparatus for polishing a workpiece comprising:

a polishing unit having a polishing table having a polishing surface and a workpiece holder for holding said workpiece to press it against said polishing surface;

a dressing unit having a dresser for dressing said polishing surface;

a solution supplying unit for supplying said polishing surface with a polishing solution or a dressing solution; and a controller for controlling operation of said units, said controller sequentially performs dressing of said polishing surface while supplying a dressing solution, removing said dressing solution remaining on said polishing surface by rotating said polishing table at a dewatering rotation speed while stopping said supply of said dressing solution, and polishing said workpiece by making said workpiece slidingly contact with said polishing surface while supplying a polishing solution.

12. The apparatus of claim 11, wherein said dewatering rotation speed is larger than a rotation speed of said polishing table during said polishing unit.

13. The apparatus of claim 11, wherein a rotation speed of said polishing table during said polishing process is larger than a rotation speed of said polishing table during said dressing process.

14. The apparatus of claim 11, wherein said dewatering rotation speed is between 100~150 rpm.

15. The apparatus of claim 11, wherein said dressing solution removing unit is performed for 5~15 seconds.

16. The apparatus of claim 11, wherein acceleration at a periphery of said polishing table during said dewatering unit is 32.9~73.9 $m/s^2$.

17. The apparatus of claim 11, wherein said polishing unit comprises a first polishing step using a first polishing solution and a second polishing step using a second polishing solution.

18. The apparatus of claim 17, wherein said second polishing solution is deionized water.

19. The apparatus of claim 11, wherein said dewatering rotation speed is determined according to a driving ability of said polishing table.

* * * * *